United States Patent [19]

Igarashi

[11] Patent Number: 4,847,593

[45] Date of Patent: Jul. 11, 1989

[54] TRANSMISSION CIRCUIT OF FIRE PROTECTION/SECURITY SYSTEM

[75] Inventor: Akira Igarashi, Tokyo, Japan

[73] Assignee: Nohmi Bosai Kagyo Kabushiki Kaisha, Tokyo, Japan

[21] Appl. No.: 110,759

[22] PCT Filed: May 18, 1987

[86] PCT No.: PCT/JP87/00314

§ 371 Date: Sep. 15, 1987

§ 102(e) Date: Sep. 15, 1987

[87] PCT Pub. No.: WO87/07418

PCT Pub. Date: Mar. 12, 1987

[30] Foreign Application Priority Data

May 28, 1986 [JP] Japan ..... 61-123068

[51] Int. Cl.[4] ..... G08B 26/00

[52] U.S. Cl. ..... 340/518; 340/506; 340/505; 340/531

[58] Field of Search ..... 340/518, 505, 825.06, 340/825.07-825.13, 506, 588, 589, 531

[56] References Cited

U.S. PATENT DOCUMENTS

| | | | |
|---|---|---|---|
| 3,508,260 | 4/1970 | Stein | 340/505 |
| 3,713,142 | 1/1973 | Getchell | 340/505 |
| 4,206,449 | 6/1980 | Galvin et al. | 340/505 |
| 4,658,243 | 4/1987 | Kimura et al. | 340/505 |

OTHER PUBLICATIONS 52-25993, 2-26-77, Japan, Kazumasa Murakami.
51-122398, 10-26-76, Japan, Shigeo Ohara et al.
54-95875, 7-28-79, Japan, Hisakatsu Honda.

*Primary Examiner*—Donnie L. Crosland
*Attorney, Agent, or Firm*—Wenderoth, Lind & Ponack

[57] ABSTRACT

A transmission circuit is disposed in at least one of a control panel and a plurality of terminal devices of a fire protection/security system, wherein the control panel individually polls the terminal devices to read in terminal information from the terminal devices, to judge and/or display the information, or to control the terminal devices. The transmission circuit includes a signal sending device for sending a signal to a signal line, a memory device for storing a signal to be sent to the signal line, and a coincidence decision device for deciding a coincidence between the signal sent from the signal sending device and the signal stored in the memory device.

2 Claims, 2 Drawing Sheets

TRANSMISSION CIRCUIT OF FIRE PROTECTION/SECURITY SYSTEM

DESCRIPTION

1. Technical Field

The present invention relates to a transmission circuit of a fire protection/security system, and more particularly to a transmission circuit which is disposed in a control panel or in each terminal device of a fire protection/security system wherein the control panel individually polls a plurality of terminal devices to read-in terminal information from the terminal devices, to judge and/or display the information, or to control the terminal devices.

2. Background Art

There is known in the art a fire protection/security system, such as a fire alarm system or an antitheft system, wherein the control panel of the system polls terminal devices and reads in monitoring information from the terminal devices so as to judge the occurrence of an abnormality such as a fire or an intrusion and/or to send control information to the terminal devices.

In the prior-art fire protection/security system, a signal different from the one that ought to be sent is, in some cases, sent from the control panel on account of troubles in, e. g., the signal sending means within the control panel. Similarly, a signal different from the one that ought to be sent is, in some cases, sent from any of the terminal devices on account of troubles in, e. g., the signal sending means within the terminal device.

In addition, when two or more of the terminal devices send signals simultaneously, the signals are combined, and a signal different from the one that ought to be sent is transmitted. The same applies in the case where the terminal device and the control panel send signals simultaneously, resulting in the transmission of a signal different from the one to be sent. Further, in a case where noise has entered the transmission line which connects the control panel with the terminal devices or where the transmission line has short-circuited, a signal different from the one to be sent is, in effect, sent.

In the aforementioned cases, there is the problem that a terminal device other than the one called during polling responds erroneously or that the control panel fails to correctly identify a zone where an abnormality has occurred.

DISCLOSURE OF THE INVENTION

The present invention has been made in view of the problem of the prior-art system stated above, and has for its object to provide, in a transmission circuit which is disposed in a control panel or in each terminal device of a fire protection/security system wherein the control panel individually polls a plurality of terminal devices to read in terminal information from the terminal devices, to judge and/or display the information, or to control the terminal devices, a transmission circuit of a fire protection/security system by which one can know for certain that a right signal to be sent by the control panel or the terminal device has been actually sent.

In order to accomplish this object, the present invention consists of a transmission circuit which is disposed in a control panel or in each terminal device of a fire protection/security system wherein a plurality of terminal devices are individually polled by the control panel to read in and/or judge terminal information from the terminal devices, to display judged results etc. or to control the terminal devices on the basis of the judged results, and is characterized by comprising a signal sending means for sending a signal to a signal line, memory means for storing a signal to be sent to the signal line, and a coincidence decision circuit for deciding a coincidence between the signal sent from said signal sending means and the signal stored in said memory means.

BRIEF DESCRIPTION OF THE DRAWINGS

FIG. 1 is a block diagram showing an embodiment of the present invention; while

BEST MODE FOR CARRYING OUT THE INVENTION

Figure 1:
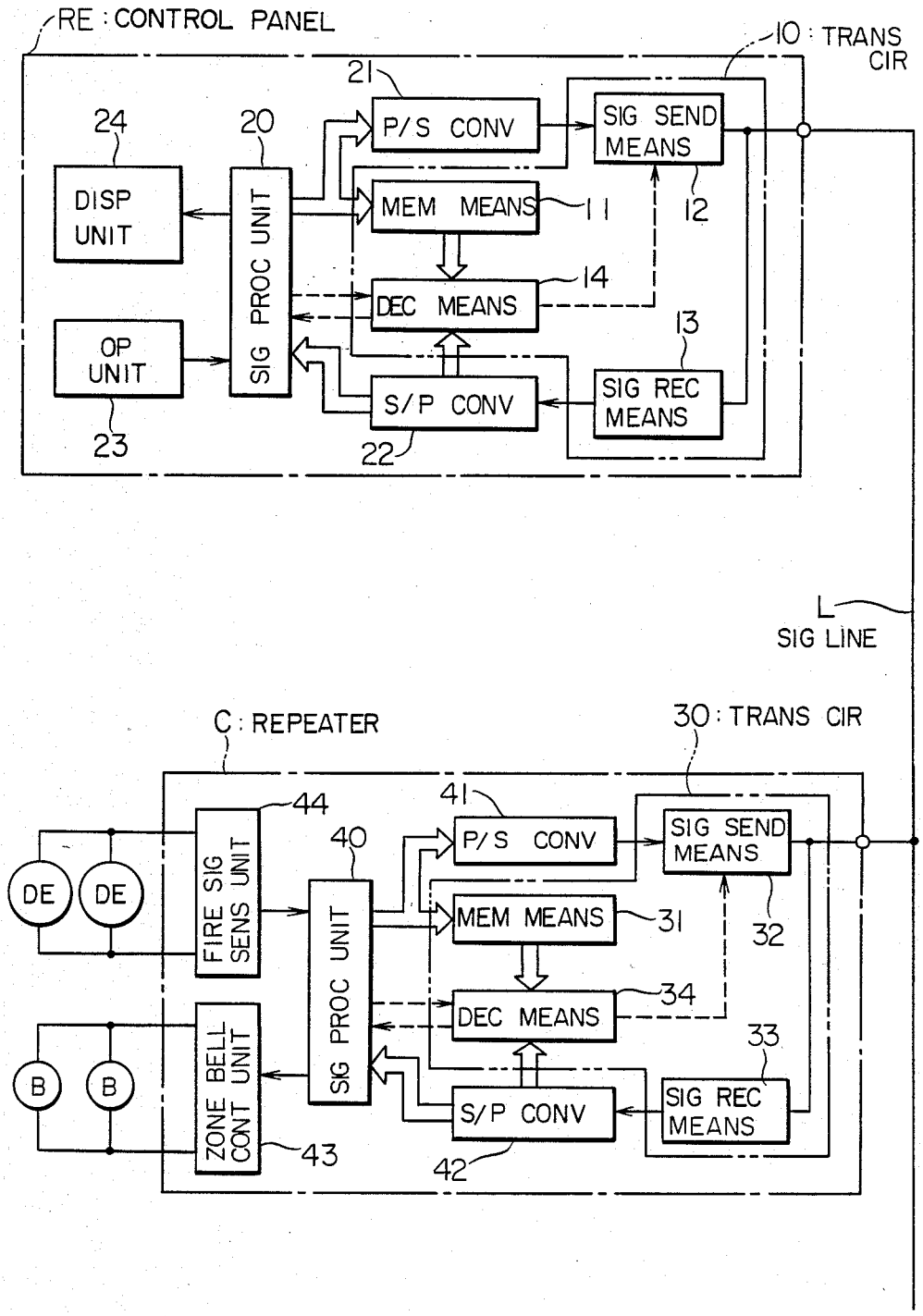

FIG. 1 is a block diagram showing an embodiment of the present invention.

A control panel RE is the control panel of a fire protection/security system such as a fire alarm system or an antitheft system. It includes a transmission circuit 10, a signal processing unit 20, a parallel-serial converter 21 which converts parallel signals into serial signals, a serial-parallel converter 22 which converts serial signals into parallel signals, an operation unit 23, and a display unit 24.

The transmission circuit 10 comprises memory means 11 for receiving and storing a signal to be transmitted thenceforth, from the signal processing unit 20, the signal sending means 12 for sending the serial signals to-be-transmitted delivered from the parallel-serial converter 21, to a signal line L, the signal receiving means 13 for receiving a signal sent from the signal sending means 12, and the coincidence decision means 14.

The signal sending means 12 is constructed of a driver or gate which amplifies the signal, while the signal receiving means 13 also serves as a reception circuit which receives a signal sent from another terminal device such as a repeater C.

The coincidence decision means 14 compares the signal stored in the memory means 11 with the signal sent from the signal sending means 12. In a case where both the signals are not coincident, the coincidence decision means 14 delivers a signal for stopping signal transmission to the signal processing unit 20 and the signal sending means 12, upon judging that the signal sending means 12 has sent an erroneous signal or that the repeater C is simultaneously sending a signal (so-called "signal collision" has arisen).

When supplied with signals of a predetermined number of bits from the signal receiving means 13, the serial-parallel converter 22 delivers a receive interruption signal to the coincidence decision means 14. Further, the signal processing unit 20 and the coincidence decision means 14 are constructed of a CPU (central processing unit).

The repeater C includes a transmission circuit 30, a signal processing unit 40, a parallel-serial converter 41, a serial-parallel converter 42, a local bell control unit 43, and a fire signal sensing unit 44.

The repeater C is shown as being representative of a plurality of terminal devices connected to the control panel RE, while in practice other terminal devices are also connected.

The transmission circuit 30 comprises the memory means 31, the signal sending means 32, the signal receiving means 33, and the coincidence decision means 34, and it is basically the same as the transmission circuit 10 of the control panel RE. That is, the memory means 31, the signal sending means 32, the signal receiving means 33 and the coincidence decision means 34 are similar to the memory means 11, the signal sending means 12, the signal receiving means 13 and the coincidence decision means 14, respectively. Moreover, the signal receiving means 33 also serves as a reception circuit which receives the signal sent from the control panel RE.

Also, a plurality of local bells B are connected to the local bell control unit 43, and a plurality of fire detectors DE are connected to the fire signal sensing unit 44.

The terminal devices are sensors such as fire sensors, fire detectors, gas sensors and intrusion sensors which detect an abnormal state; controlled devices such as alarm bells, audible equipment, fire prevention equipment, smoke ventilating equipment and fire extinguishing equipment; and repeaters to which the above sensors or the controlled devices are connected; etc.

Next, the operation of the above embodiment will be described.

Figure 2:
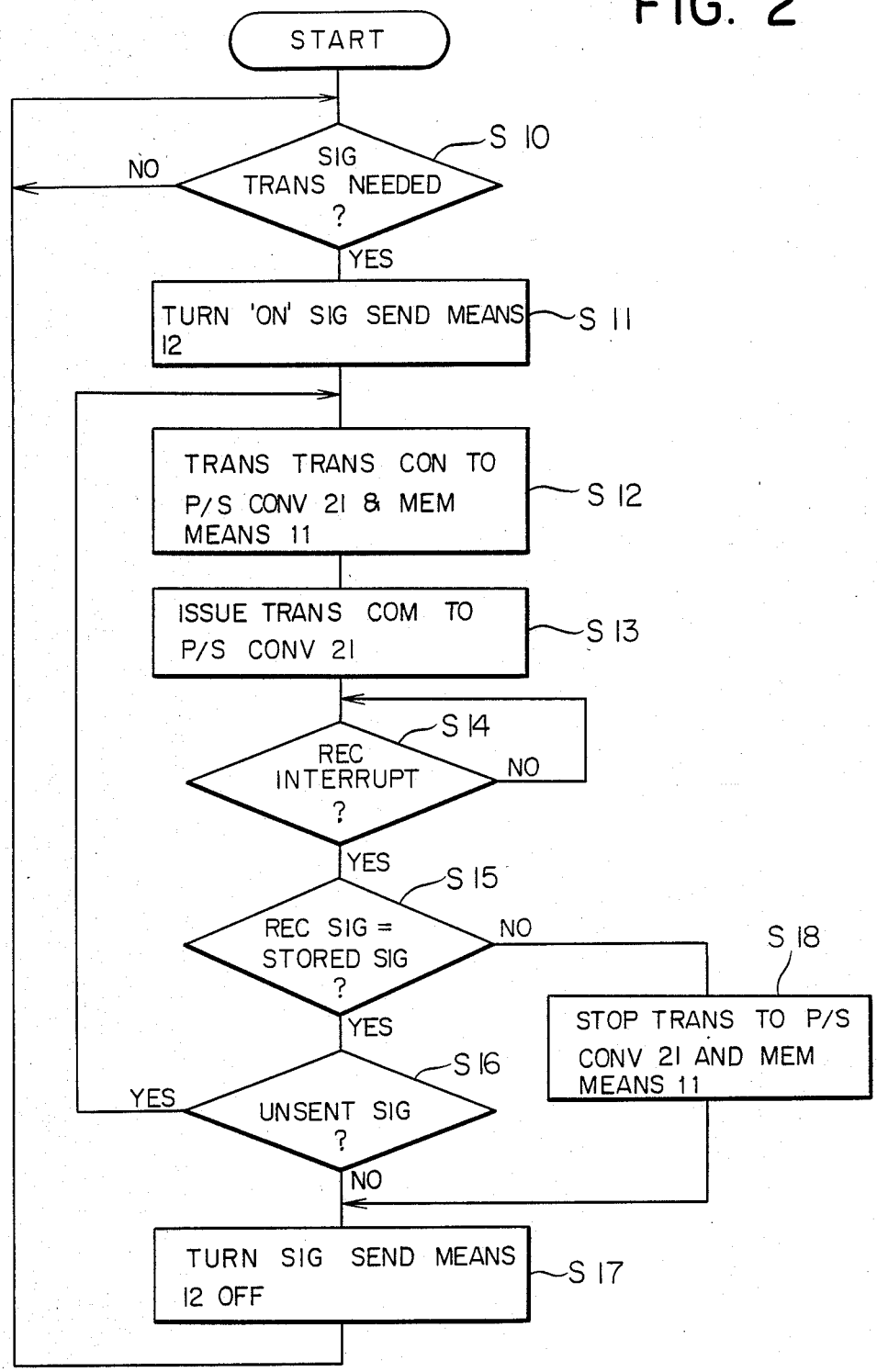
FIG. 2 is a flow chart showing the operation of the embodiment.

FIG. 2 is a flow chart showing the operation of the above embodiment.

Referring to the flow chart of FIG. 2, the signal processing unit 20 first judges whether or not the control panel RE needs to send a signal (S10). If the control panel needs to send the signal, the signal processing unit 20 turns 'on' the signal sending means 12 (S11), delivers a transmission content to the parallel-serial converter 21 and the memory means 11 (S12), and delivers a transmission command to the parallel-serial converter 21 (S13). Thus, the parallel-serial converter 21 converts parallel signals into serial signals and delivers the latter, and the signal sending means 12 sends the serial signals to the signal line L. The signal receiving means 13 receives the signal sent from the signal sending means 12, and applies the received signal to the serial-parallel converter 22. When the serial-parallel converter 22 has been supplied with signals of a predetermined number of bits, for example, 8 bits from the signal receiving means 13, it delivers a receive interruption signal to the coincidence decision means 14. In response to the receive interruption signal, the coincidence decision means 14 judges whether or not the received signal applied to the serial-parallel converter 22 coincides with the signal stored in the memory means 11 (Sl5). That is, it judges whether or not the signal to be sent and the signal actually sent are coincident.

When the coincidence has been acknowledged in the coincidence decision means 14 (S15), the steps S12–S15 are repeated until all signals that have not been transmitted are sent out (S16). Then, when all the signals have been sent out, the signal processing unit 20 issues a stop command to the signal sending means 12 (S17) so as to establish a stand-by state.

On the other hand, in a case where the signal sent from the signal sending means 12 does not coincide with the signal stored in the memory means 11 at the step S15, that is, when an erroneous signal has been sent, the signal processing unit 20 is inhibited from providing its output to the parallel-serial converter 21 and the memory means 11 (S18), and the signal sending means 12 is turned 'off' (S17).

As to cause for which both the signals do not coincide in the coincidence decision means 14 in this manner, it is considered by way of example that the signal sending means 12 or the parallel-serial converter 21 has troubles or that another terminal device such as the repeater C sent a signal simultaneously. In this case, the subsequent signal transmission is stopped so as to prevent an erroneous judgement or confusion attributed to the transmission of the erroneous signal. Moreover, since the signal receiving means 13 or 33 and the serial-parallel converter 22 or 42 are also used as the reception circuit in the embodiment, whether or not the signal receiving means of the control panel or the repeater of the reception circuit is normally operating can be known by monitoring the transmission state of the transmission circuit.

Although the flow chart shown in FIG. 2 elucidates the operation of the control panel RE, the terminal devices such as the repeaters C can be similarly described.

According to the present invention, in a transmission circuit which is disposed in a control panel or each terminal device of a fire protection/security system wherein the control panel polls a plurality of terminal devices individually to read in terminal information from the terminal devices, to judge and/or display the information, or to control the terminal devices, there is such an effect that the actual transmission of a signal which the control panel or the terminal device ought to transmit can be reliably known.

What is claimed is:

1. A transmission circuit, said transmission circuit disposed in at least one of a control panel and a plurality of terminal devices of a fire protection/security system, wherein said control panel individually polls said plurality of terminal devices, said transmission circuit comprising:

a signal sending means for sending a signal to be transmitted to a signal line;

a memory means for storing said signal to be transmitted;

a coincidence decision means, coupled to an output of said signal sending means and to said memory means, for comparing said signal to be transmitted sent from said signal sending means with said signal to be transmitted stored in said memory means.

2. A transmission circuit as claimed in claim 1, wherein said coincidence decision means comprises a means to stop a sending of a signal when said compared signals to be transmitted are not identical.

* * * * *